US011841161B2

(12) United States Patent
Pozniak et al.

(10) Patent No.: US 11,841,161 B2
(45) Date of Patent: Dec. 12, 2023

(54) PROFILED DAMPER AND FAN FOR CONTROLLING AIR FLOW DIRECTION IN AN AIR DUCT

(71) Applicant: Przedsiebiorstwo Produkcyjno Handlowo Uslugowe STROPEX Renata Bruzi, Krzysztof Bruzi Spolka Jawna, Dobrzyca (PL)

(72) Inventors: Mariusz Pozniak, Leszno (PL); Artur Poźniak, Poznan (PL); Marek Zacharski, Poznan (PL); Jaroslaw Biernacki, Suchy las (PL); Aleksandra Przydrozna, Wroclaw (PL)

(73) Assignee: RESPIRECO SPOLKA Z OGRANICZONA ODPOWIEDZIALNOSCIA, Pleszew (PL)

( * ) Notice: Subject to any disclaimer, the term of this patent is extended or adjusted under 35 U.S.C. 154(b) by 642 days.

(21) Appl. No.: 16/323,451

(22) PCT Filed: Aug. 9, 2017

(86) PCT No.: PCT/PL2017/000078
§ 371 (c)(1),
(2) Date: Feb. 5, 2019

(87) PCT Pub. No.: WO2018/030903
PCT Pub. Date: Feb. 15, 2018

(65) Prior Publication Data

US 2019/0170389 A1 Jun. 6, 2019

(30) Foreign Application Priority Data

Aug. 10, 2016 (PL) ..... 418279

(51) Int. Cl.
*F24F 13/065* (2006.01)
*F24F 7/06* (2006.01)
(Continued)

(52) U.S. Cl.
CPC ..... *F24F 13/065* (2013.01); *F24F 7/065* (2013.01); *F24F 13/10* (2013.01); *F24F 2007/005* (2013.01)

(58) Field of Classification Search
CPC ..... F24F 13/02; F24F 13/10; F24F 2007/005; F24F 7/06; F24F 13/065; F24F 7/065; F24F 2007/0005
(Continued)

(56) References Cited

U.S. PATENT DOCUMENTS 1,848,811 A * 3/1932 Welch ..... F26B 15/00 34/224
2,184,484 A * 12/1939 Bojner ..... F24F 7/08 454/251
(Continued)

FOREIGN PATENT DOCUMENTS

CN 105650798 A * 6/2016
CN 105650800 A * 6/2016
(Continued)

OTHER PUBLICATIONS

CN105650798A_Description: Machine translation of CN105650798A from ESpacenet (Year: 2016).*
(Continued)

*Primary Examiner* — Edelmira Bosques
*Assistant Examiner* — Frances F. Hamilton
(74) *Attorney, Agent, or Firm* — MYERS WOLIN, LLC

(57) ABSTRACT

A device for controlling air flow in an air duct comprises a rotary, profiled damper, a fan or turbine, and an actuator. The profiled damper comprises two rotatable integral canopies, a
(Continued)

central opening therebetween, flat ribs extending outwardly from the canopies and towards an interior of the air duct, wherein an axis of rotation of said canopies coincides with an axis of rotation of the profiled damper and the canopies are arranged on the opposite sides of the profiled damper. The profiled damper is characterized in that the actuator is configured to reverse a position of the profiled damper, thereby reversing a direction of an air stream generated by the fan or turbine.

3 Claims, 9 Drawing Sheets

(51) Int. Cl.
*F24F 13/10* (2006.01)
*F24F 7/00* (2021.01)

(58) Field of Classification Search
USPC ..... 454/286
See application file for complete search history.

(56) References Cited

U.S. PATENT DOCUMENTS 2,347,936 A * 5/1944 Crewson ..... F26B 21/04 454/236
4,228,786 A * 10/1980 Frankenfield ..... F24F 5/0046 126/400
4,353,412 A * 10/1982 Krumhansl ..... F24D 11/0264 165/59
4,589,476 A * 5/1986 Berner ..... F24F 3/16 165/4
5,050,667 A 9/1991 Berner et al.
5,230,719 A * 7/1993 Berner ..... F24F 12/001 165/4
5,687,764 A * 11/1997 Tanaka ..... F16K 11/0525 137/625.43
6,207,447 B1 * 3/2001 Gould ..... F24F 11/0001 435/290.1
8,961,281 B2 * 2/2015 Cella Mazzariol ... F04D 27/005 454/251
2011/0171895 A1 * 7/2011 Tanishima ..... B66B 11/0226 454/68
2011/0281516 A1 * 11/2011 Newcomer ..... F24F 7/08 454/231
2014/0273797 A1 * 9/2014 Jensen ..... F24F 7/065 454/251
2015/0132838 A1 * 5/2015 Cella Mazzariol ..... F04D 25/10 415/126
2015/0276248 A1 * 10/2015 Bailey ..... F24F 3/16 454/356
2021/0164673 A1 * 6/2021 Bruzi ..... F04D 29/503

FOREIGN PATENT DOCUMENTS

DE 4115710 A1 4/1992
DE 9206729 U 6/1993
DE 4216387 A1 8/1993
DE 19811469 A1 9/1999
EP 2325573 A2 5/2011
JP 2001-193979 A 7/2001
KR 20170079281 A * 7/2017
PL 65013 6/2010
PL 410893 7/2016
PL 228837 B1 5/2018
WO 2012/155913 A1 11/2012
WO WO-2016153371 A1 * 9/2016 ..... F24F 7/00

OTHER PUBLICATIONS

DE4216387A1_Description: Machine translation of DE4216387A1 from ESpacenet (Year: 1993).*
International Search Report and Written Opinion dated Jan. 5, 2018, from International Application No. PCT/PL2017/000078, 10 sheets.
Polish Search Report dated May 19, 2017, from Polish Application No. P418279, 1 sheet.

* cited by examiner

PROFILED DAMPER AND FAN FOR CONTROLLING AIR FLOW DIRECTION IN AN AIR DUCT

CROSS-REFERENCE TO RELATED APPLICATIONS

This application is an entry into the national phase under 35 U.S.C. 371 of the international application no.: PCT/PL2017/000078, filed Aug. 9, 2017, which claims priority from Polish patent application no. P.418279, filed Aug. 10, 2016, the contents of each of which are incorporated herein by reference in their entirety.

FIELD OF THE INVENTION

The present invention relates to a device for controlling air flow in the air duct by reversing the direction of both:

- an air stream driven by a fan which continuously rotates in a fixed direction, to obtain an air flow which cyclically changes direction
- an air stream which cyclically changes direction to be delivered to the unidirectional, high performance air turbine for production of electric energy.

BACKGROUND

The air flow reversal device for a ventilation system currently used on the market comprises of a fan, and is provided with a cylindrical damper comprising at least two coaxial cylinders. One of these, preferably the inner cylinder, is movable and rotatable and placed in the second cylinder, which is preferably a fixed outer cylinder. Inside the inner cylinder there is an attached partition, to which the suction port of the fan is connected. The partition is permanently fixed to the inner cylinder, and together with the two discs that close this cylinder at both ends, it constitutes the fan chamber. The internal cylinder is mounted in the casing and is driven by the rotary actuator. The inner cylinder rotates at a 180° angle to the left and at a 180° angle to the right, or the rotation takes place in one direction, cyclically stopping every 180 degrees. The cylindrical damper has openings which constitute airflow windows located on the outer and inner surfaces of the cylinders.

The inside of the rotary cylinder constitutes the fan chamber, which is divided into a lower part, the so-called suction chamber, and an upper part. The upper part constitutes the casing for the fan rotor, driven by the electrical motor. Both upper and lower parts are connected by a suction port. In the outer cylinder there are four rectangular openings with rounded corners. They have the following dimensions: the width expressed by the obtuse angle (the opening angle no greater than 180°) and the height smaller than half the height of the outer cylinder. These are arranged in pairs, one above the other, where both pairs are symmetrically opposite each other. The outer cylinder has the following openings: bottom right, top right, bottom left and top left. The outer cylinder is connected to the expansion chamber, and one of its openings, for example the bottom right opening, forms a connection to the on one side, and the exhausted-exhaust air and respectively, the top right opening forms a connection to the inlet air ducts on the other side. There are two rectangular rounded corner openings in the inner cylinder in the upper right and lower left, with the following dimensions: the width expressed by the obtuse angle (the opening angle not greater than 180°) and the height smaller than half the height of the outer cylinder.

During the rotation of the inner cylinder, while its top opening coincides with the top left opening of the outer cylinder, the right bottom opening of the inner cylinder coincides with the lower right opening of the outer cylinder, and the lower left opening and top right opening remain closed. After the inner cylinder has rotated by 180°, the windows in the outer cylinder open, and the windows which were open now close.

Disadvantages of Prior Art

Existing devices designed to change the direction of air flow have an extensive construction and limited use.

Purpose of the Invention

This invention is made to overcome the above disadvantages, the substance of which is set forth in claims.

SUMMARY OF THE INVENTION

A device for controlling air flow in an air duct according to the invention is provided with a rotary, profiled damper, and a working machine in the form of a fan or a turbine is placed, wherein the damper comprises two integral canopies having a common axis of rotation with the damper. The device according to the invention characterized in that the canopies of which are located on the opposite sides of the damper are configured such that a central opening is formed between the canopies in a plane perpendicular to the axis of rotation. The two integral canopies comprise a suction/inlet and a compression/outlet, and are exteriorly connected by two flat ribs that are symmetrical about the axis of rotation, the ribs extend outwardly from the canopies towards perimeter sealing edges. The air duct comprises an interior partition formed in a plane parallel to the damper, capable of tightly fitting to the edges of the damper, separating a first part and a second part of the air duct.

In the first version, the apparatus is provided with a radial working machine which is arranged in the suction/inlet canopy of the profiled damper, and a central opening is located in the suction port that is positioned in a compression/outlet canopy. In this version the radial fan is a fan comprising a rotor and a motor that is mounted on a fixed pin or a radial air turbine, including a generator mounted on a fixed pin, is the working machine.

The device in the second version is equipped with an axial working machine, which is arranged in a channel in which the central opening is located. The channel connects the suction/inlet with the compression/outlet canopies of the profiled damper, the profiled damper is rotatable, and mounted on a stationary axis that is attached to the air duct by means of a flanged bushing.

The channel has a circular cross section with an axis that coincides with the symmetrical axis of the profiled damper, which acts as the axis of rotation of the profiled damper. In this version, the axial working machine is an axial fan comprising a rotor and a motor or axial-flow turbine that includes a generator, wherein the generator is mounted on a fixed axis such that the generator stator remains motionless with the stationary axis and the rotating winding is connected to the axial turbine rotor.

Advantages of the Invention

The device according to the present invention simplifies the profiled damper structure by eliminating the outer cylinder used in known apparatus, changing the cylindrical shape damper to a flat one with suction/inlet and compression/outlet canopies. The profiled damper design allows it to work not only with a radial fan and a radial turbine, but also with an axial fan and with an axial turbine.

BRIEF DESCRIPTION OF THE DRAWINGS

The subject of the invention is shown in the exemplary drawings where.

Figure 1:
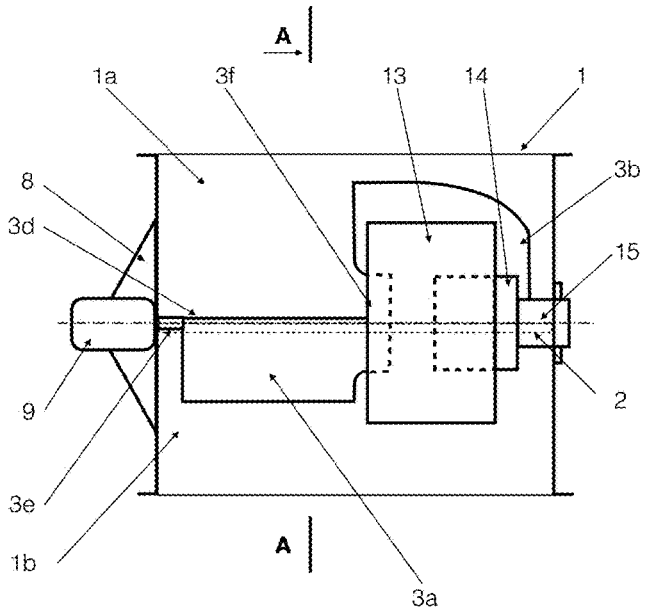
FIG. 1 shows the a vertical cross-section of the device for controlling air flow inside the air duct, with a rotating profiled damper and a radial fan.

An example embodiment of the invention:

The device to control an air flow direction in an air duct according to the invention consists of the air duct 1 and a working machine arrangement placed in a profiled damper 3. The device may be equipped, depending on the version, with the working machine in the form of a radial or axial fan and a radial or axial turbine. The damper is a specially profiled rotary damper 3 with two embosses, formed as canopies, and a circular central opening formed therebetween, the canopies comprise a suction/inlet canopy 3*a* and a compression/outlet canopy 3*b*, and are so arranged that they are on opposite sides of a plane of the damper and have a common axis of rotation with the profiled damper 3. The relative positioning of the canopies 3*a* and 3*b* cause the central opening to be formed a plane perpendicular to the axis of rotation of the profiled damper 3.

The profiled damper 3 obtains the drive from the actuator 9, which is fixed by the stationary support 8 to the air duct wall 1. The profiled damper 3 has the ability to shuttle rotation by an angle of no more than 180 degrees. In extreme positions, the damper 3, due to tight fit between the edges 4 of the dividing-sealing shelf 2, tightly separates the upper part 1*a* of air duct 1 from the bottom part 1*b*. The profiled damper 3, with all its sealing edges 4, comes into contact with the sealing of the dividing-sealing shelf 2, made inside the air duct 1.

The profiled damper 3, driven by the actuator 9, can rotate by an angle of no more than 180 degrees. During such rotations the position of the canopy 3*a* and 3*b* relative to the air duct 1 changes, so that the canopy that is in the upper part of the air duct 1 moves to its lower part, and the canopy that is in the lower part of the air duct 1 moves to its upper part. The rotation takes place in the shortest possible time, during which the system is not airtight and the air streams can mix.

Figure 2:
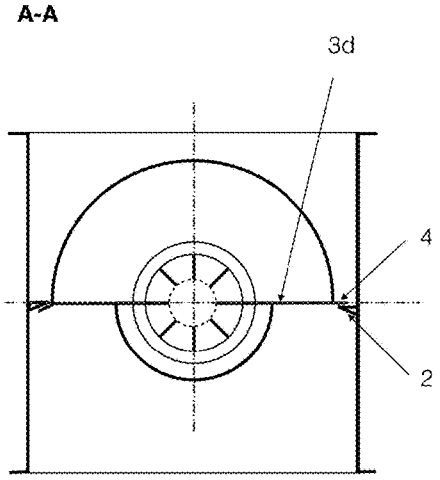
FIG. 2 shows the profiled damper with the radial fan in the A-A horizontal cross-section.
Figure 3:
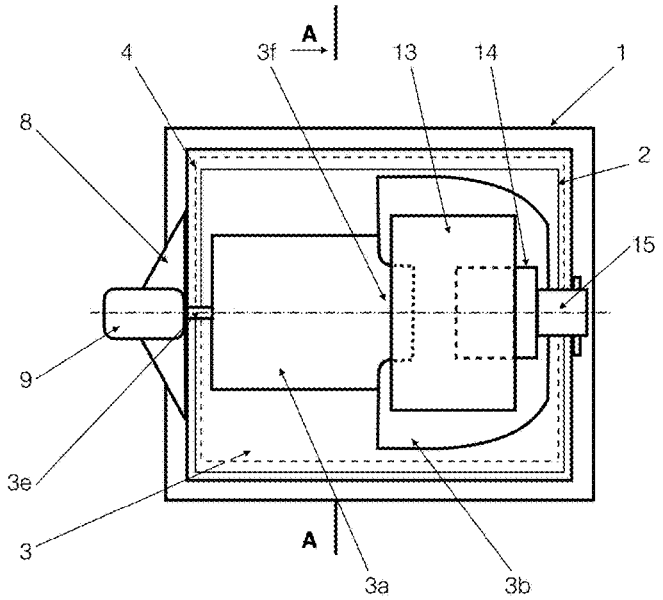
FIG. 3 shows the profiled damper with the radial fan in a horizontal cross-section.
Figure 4:
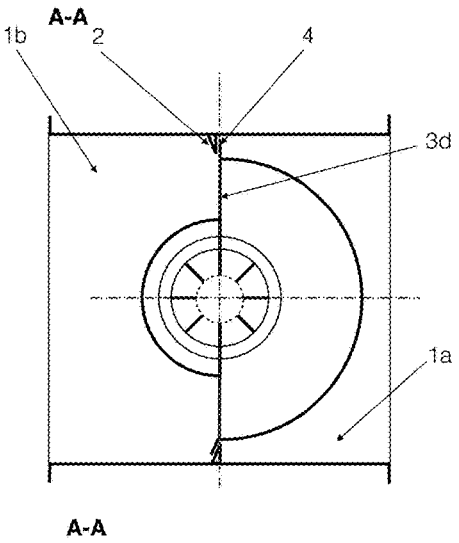
FIG. 4 shows the profiled damper with the radial fan according to claim 3 in the A-A cross-section.
Figure 5:
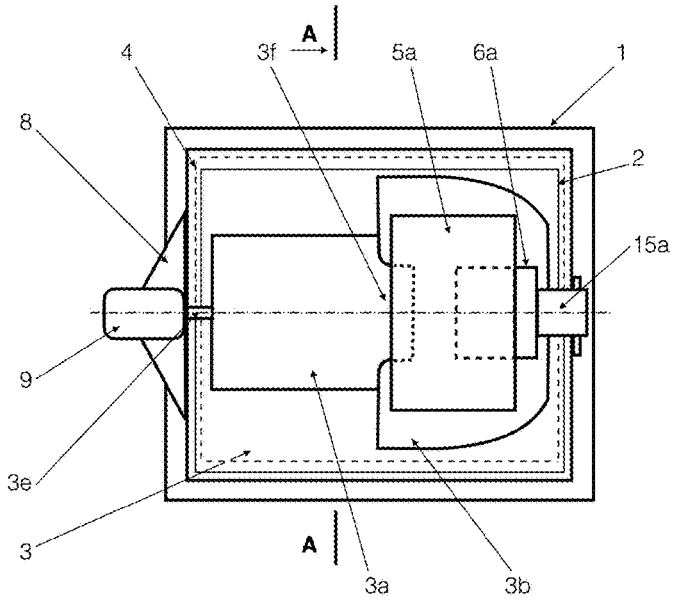
FIG. 5 shows the profiled damper with the radial turbine in a horizontal cross-section.
Figure 6:
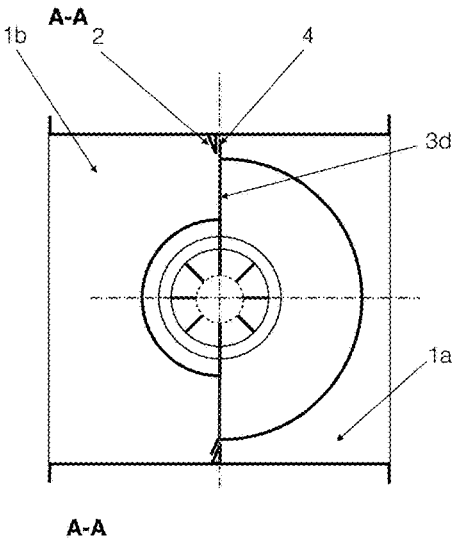
FIG. 6 shows the profiled damper with the radial turbine in the A-A horizontal cross-section.
Figure 7:
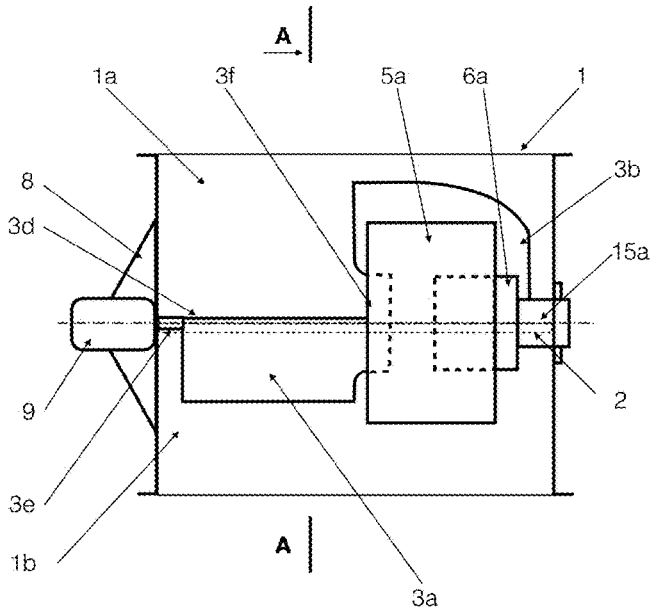
FIG. 7 shows the profiled damper with the radial turbine in a vertical cross-section.
Figure 8:
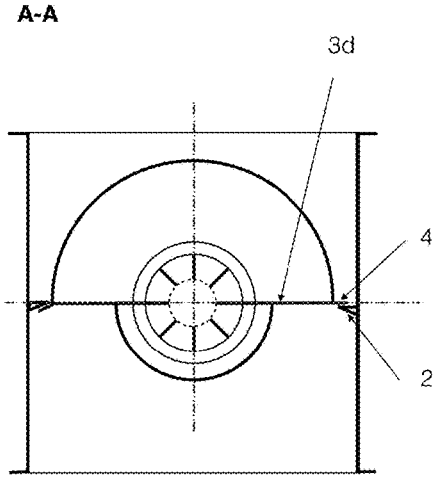
FIG. 8 shows the profiled damper with the radial turbine according to claim 7 in the A-A horizontal cross-section.
Figure 9:
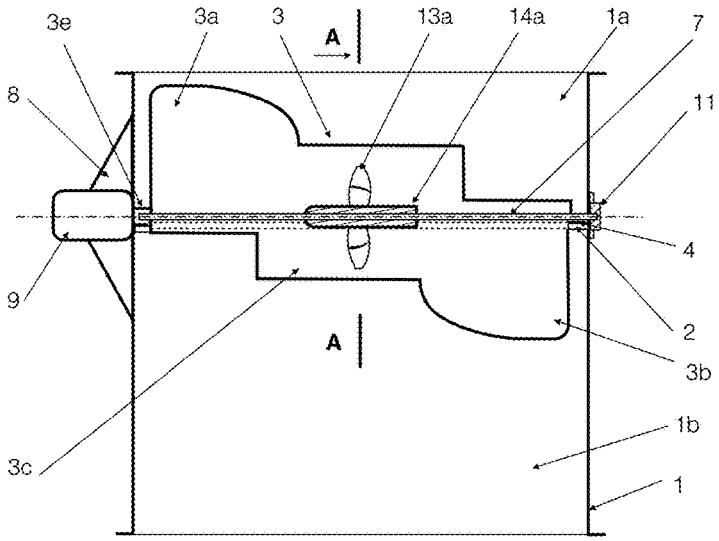
FIG. 9 shows the profiled damper with the axial fan in a vertical cross-section.
Figure 10:
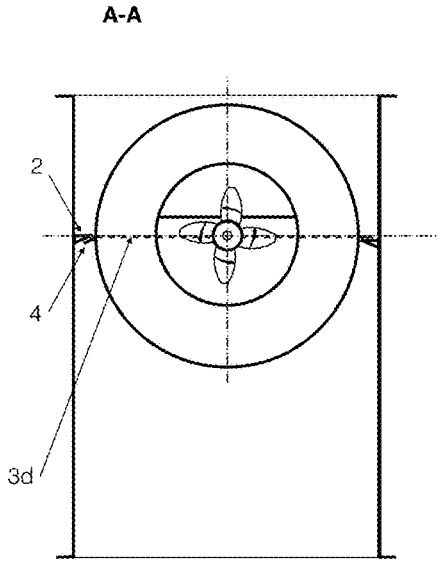
FIG. 10 shows the profiled damper with the axial fan in the A-A horizontal cross-section.
Figure 11:
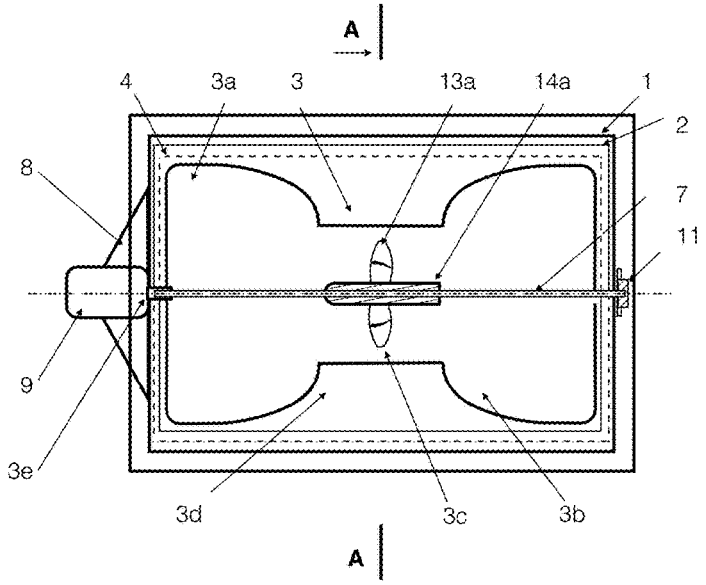
FIG. 11 shows the profiled damper with the axial fan in a horizontal cross-section.
Figure 12:
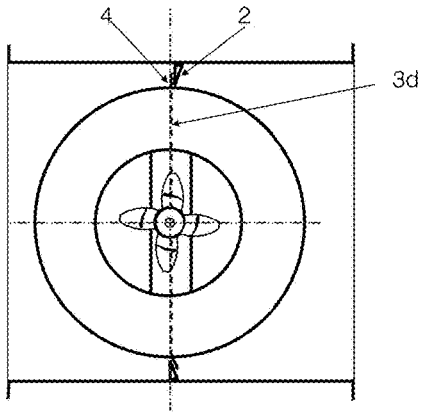
FIG. 12 shows the profiled damper with the axial fan according to claim 11 in the A-A horizontal cross-section.
Figure 13:
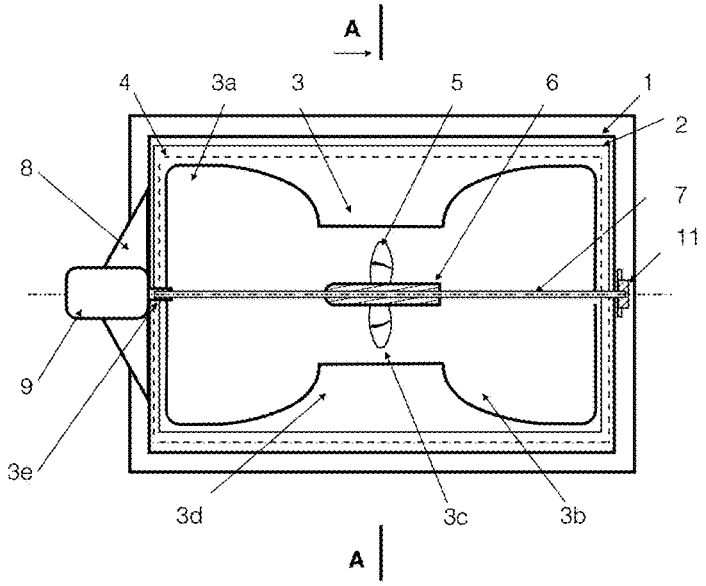
FIG. 13 shows the profiled damper with the axial turbine in a horizontal cross-section.
Figure 14:
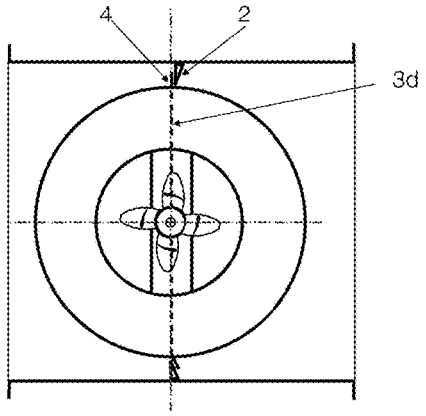
FIG. 14 shows the profiled damper with the axial turbine in the A-A horizontal cross-section.
Figure 15:
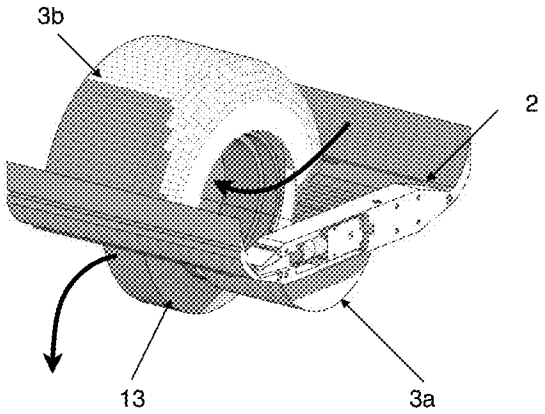
FIG. 15 shows a perspective view of the profiled damper, in one of the extreme positions.
Figure 16:
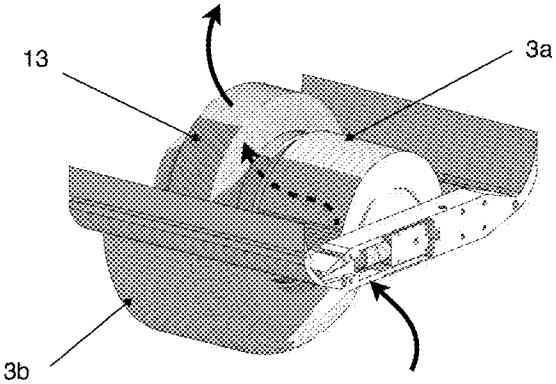
FIG. 16 shows a perspective view of the profiled damper, in the second extreme position.
Figure 17:
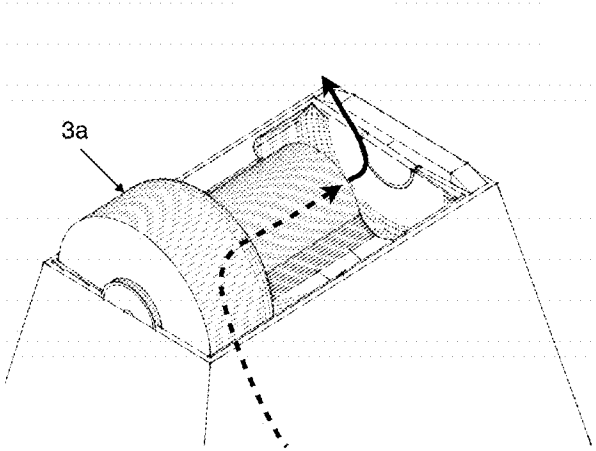
FIG. 17 shows a perspective view of the profiled damper with an axial fan, in one of the extreme positions.
Figure 18:
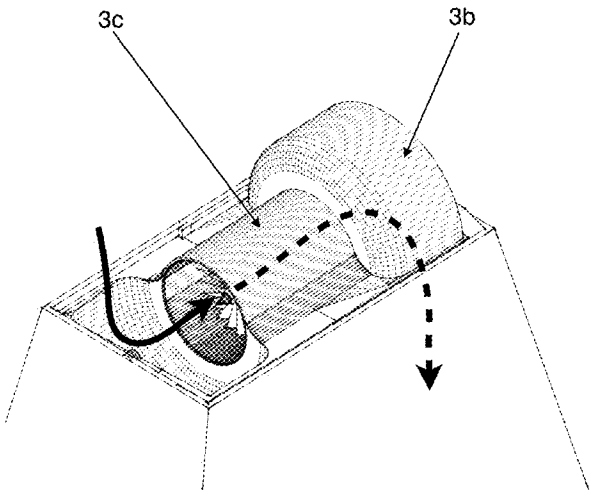
FIG. 18 shows a perspective view of the profiled damper with an axial fan, in the second extreme position.

The device according to the invention can be made in two versions. The first version is a device equipped with a radial working machine shown on FIG. 1 to FIG. 8, and in the second version, there is a device with an axial working machine shown on FIG. 9 to FIG. 14.

In the first version, the radial working machine has the form of a radial fan or radial turbine. The radial machine is placed in the compression/outlet canopy 3*b* and the central opening 3 is placed in the suction port 3*f*, located in the compression/outlet canopy 3*b*. If a fan is used, the working machine draws in air, and if a turbine is used, the working machine collects air from the suction/inlet canopy 3*a*, directing it through the central opening in the suction port 3*f* to the suction/outlet canopy 3*b*.

According to FIG. 1-4, the device in the first version is used to reverse the direction of the air flow in the air duct 1, which is driven by the radial fan continuously rotating in a fixed direction, provided with a rotor 13 and a motor 14. As shown in FIG. 5-8, this device is used to direct air coming from different directions into the air duct 1 on to the proper side of the radial turbine 5*a*, continuously rotating in a fixed direction, provided with the generator 6*a*. The rotary single plane profiled damper 3 in this version has a profiled shape formed by: a suction/inlet canopy 3*a*, a compressing/outlet canopy 3*b* and a central opening with the suction port 3*f*. Two symmetrical flat ribs connect the suction/inlet canopy 3*a* and the compressing/outlet canopy 3*b* forming a tight diaphragm with its sealing edges 4, tightly attached to the partition-sealing shelf 2. The profiled damper 3 has the ability to rotate pendulously at an angle of no more than 180 degrees. In extreme positions the profiled damper 3, by attaching the edges 4 to the partition-sealing shelf 2, tightly separates the upper part 1*a* from the bottom part 1*b* of the air duct 1. The profiled damper 3 is rotatably mounted in the air duct 1, either on the fixed shaft 15, holding the radial fan motor 14, or on the fixed shaft 15*a*, holding the radial turbine generator 6*a*, as well as on the hollow connector 3*e* mounted in the air duct 1. The actuator 9 of the rotary drive of the profiled damper is attached via the fixed support 8 to the air duct housing 1.

In the second version of the device an axial working machine is used in the form of an axial fan or an axial turbine. The axial machine is located in the channel 3*c*, in which the central opening is also positioned. The axial working machine sucks in, in the case of a fan, or draws in, in the case of the turbine, air from the sucking/inlet canopy 3*a*, causing the air to flow through the air duct 3*c* to the compression/outlet canopy 3*b*.

According to FIG. 9-12, the device in the second version is used to reverse the direction of airflow in the air duct 1 by means of an axial fan provided with a rotor 13*a* and a motor 14*a*. This device is also used to direct the air coming from different directions into the air duct 1 to the proper side of the axial turbine 5 provided with a generator 6 and is driven by air flowing through the air duct 1.

Also in this embodiment, the single leaf profiled damper 3 is formed from the channel 3*c* connecting the sucking/inlet canopy 3*a* to the compression/outlet canopy 3*b*, and two symmetrical flat-shaped ribs 3*d*. Canopies 3*a* and 3*b* are located placed symmetrically, relative to the center of the profiled damper 3. Channel 3*c* has a circular section with an axis that coincides with the axis of symmetry of the profiled damper 3, and this is also its axis of rotation. The ribs 3*d* connect the sucking/inlet canopy 3*a* to the compression/outlet canopy 3*b* and the channel 3*c*, forming a sealing diaphragm, with edges 4 of which tightly attached to the partition/sealing shelf 2.

The profiled damper 3 is rotatable and is mounted on rotary bearings, on a stationary axis 7 attached to the air duct 1 by means of a flange sleeve 11 and has the ability to rotate pendulously at an angle of no more than 180 degrees. In extreme positions, the profiled damper 3, due to the fit of the edges 4 and the partition/sealing shelf 2, tightly separates the upper part 1*a* of air duct 1 from the bottom part 1*b* of the air duct 1.

The generator 6 is mounted on the fixed axis 7 so that the generator stator 6 and the stationary axis 7 both remain motionless, and the rotating winding of the generator 6 is connected to the axial turbine rotor 5. The actuator 9 of the rotary profiled damper 3 is mounted on the fixed axis 7 to the air duct housing 1 by the fixed support 8. The shaft of the actuator 9 is connected to the rotary profiled damper 3 by the hollow connector 3*e* mounted on bearings in the air duct 1.

The operation of the device with the rotary, profiled damper 3 according to the invention is as follows: the profiled damper system in all versions is based on separating the air duct 1 into two parts by tight seals, the upper 1*a* and the lower 1*b*, which are exposed to different air pressures.

In the first version of the device the only way for the air to flow through the sealed air duct 1 is through central opening of the suction port 3*f* located in the compression/outlet canopy 3*b*, in which the radial working machine formed as an radial fan or a radial turbine is mounted.

In the second version of the device, the only way for the air to flow through the sealed air duct 1 is through a central channel 3*c* in which an axial working machine formed as an axial fan or an axial-flow turbine machine is arranged.

The cyclical rotation of the profiled damper 3 at an angle of no more than 180 degrees causes temporary unsealing of the air duct 1. If a fan is used, after the profiled damper 3 is placed in the next extreme position, the reversal of direction of airflow in the air duct 1 occurs while the radial fan 13 or the axial fan 13*a* rotor continuously rotates in one fixed direction. This is the typical use for ventilation or heat recovery systems using stationary heat exchangers. If a turbine is used, there is a constant flow of air to the turbine rotor, despite the fact that the air in the air duct 1 changes its flow direction cyclically.

The invention claimed is:

1. A device for controlling air flow in an air duct comprising a working machine in a form of a radial fan, placed in a profiled damper, the profiled damper rotatably mounted in the air duct on a fixed shaft; comprising two embossings forming two rotatable integral canopies, the canopies comprising a suction/inlet canopy and a compression/outlet canopy, wherein the canopies further comprising a suction port therebetween formed in a central opening, the canopies connected by flat ribs that extend outwardly from the canopies and towards a duct interior to form a sealing partition, wherein the canopies are arranged on opposite sides of the flat ribs and have a common axis of rotation coinciding with an axis of rotation of the profiled damper; wherein the canopies are interposed so that the suction port central opening is located in a plane perpendicular to the axis of rotation of the profiled damper; wherein the profiled damper obtains a drive from an actuator and rotates in relation to the air duct; wherein the radial fan, which continuously rotates in a fixed direction, is located in the compression/outlet canopy of the profiled damper, sucks in air from the suction/inlet canopy, through the suction port central opening, and into the compression/outlet canopy; wherein a control of the air flow direction in the air duct is obtained by rotatably reversing a position of the profiled damper such that the air flow changes direction; wherein the profiled damper flat ribs are symmetrical about the axis of rotation and comprise perimeter sealing edges; wherein the air duct comprises an inner frame, such that when the perimeter sealing edges come into contact with the inner frame, the duct is separated by tight seals into a first part and a second part which are exposed to different air pressures that permits an air stream within the duct air to reverse direction.

2. The device according to claim 1, wherein the profiled damper periodically rotates by an angle of no more than 180 degrees, wherein through contact of the perimeter sealing edges to the inner frame, the profiled damper separates the second part from the first part of the air duct and wherein position of the canopies relative to the air duct changes so that the canopy that was previously in the second part of the air duct is moved to the first part, and the canopy that was previously in the first part of the air duct is moved to the second part.

3. The device according to claim 1, wherein the profiled damper further comprises a hollow connector (3*e*) mounted in the air duct (1), such that the actuator is connected to the profiled damper by the hollow connector mounted in the air duct.

* * * * *